US008627696B2

(12) United States Patent
Pottier et al.

(10) Patent No.: US 8,627,696 B2
(45) Date of Patent: Jan. 14, 2014

(54) METHOD AND DEVICE FOR MANUFACTURING A CABLE COMPRISING TWO LAYERS OF THE IN SITU COMPOUND TYPE

(75) Inventors: Thibaud Pottier, Malauzat (FR); Henri Barguet, Les Martres-d'Artiere (FR)

(73) Assignees: Michelin Recherche et Technique S.A., Granges-Paccot (CH); Compagnie Generale des Establissements Michelin, Clermont-Ferrand (FR)

( * ) Notice: Subject to any disclaimer, the term of this patent is extended or adjusted under 35 U.S.C. 154(b) by 558 days.

(21) Appl. No.: 12/810,999

(22) PCT Filed: Dec. 22, 2008

(86) PCT No.: PCT/EP2008/011001

§ 371 (c)(1), (2), (4) Date: Oct. 5, 2010

(87) PCT Pub. No.: WO2009/083213

PCT Pub. Date: Jul. 9, 2009

(65) Prior Publication Data

US 2011/0011486 A1 Jan. 20, 2011

(30) Foreign Application Priority Data

Dec. 28, 2007 (FR) ..... 07 09163

(51) Int. Cl.

*B21B 15/02* (2006.01)
*B21C 23/22* (2006.01)
*B21D 11/14* (2006.01)

(52) U.S. Cl.

USPC ..... 72/64; 72/258; 72/371

(58) Field of Classification Search

USPC ..... 72/29, 258, 64, 65, 371; 140/30, 36, 140/118, 119, 149

See application file for complete search history.

(56) References Cited

U.S. PATENT DOCUMENTS

| | | | | |
|---|---|---|---|---|
| 4,612,792 | A * | 9/1986 | De Bondt et al. | 72/183 |
| 5,285,623 | A * | 2/1994 | Baillievier et al. | 57/236 |
| 6,837,289 | B2 * | 1/2005 | Cordonnier et al. | 152/556 |
| 8,166,741 | B2 * | 5/2012 | Barguet et al. | 57/216 |
| 8,245,490 | B2 * | 8/2012 | Barguet et al. | 57/217 |
| 2002/0160213 | A1 | 10/2002 | Imamiya et al. | |
| 2005/0003185 | A1 * | 1/2005 | Esnault et al. | 428/375 |
| 2006/0048873 | A1 * | 3/2006 | Kudo et al. | 152/209.1 |
| 2006/0237110 | A1 * | 10/2006 | Barguet et al. | 152/451 |

FOREIGN PATENT DOCUMENTS

| | | |
|---|---|---|
| EP | 1 258 558 | 11/2001 |
| FR | 2 626 904 | 8/1989 |

* cited by examiner

*Primary Examiner* — Dana Ross
*Assistant Examiner* — Lawrence Averick
(74) *Attorney, Agent, or Firm* — Cozen O'Connor

(57) ABSTRACT

Method of manufacturing a metal cable having two layers (Ci, Ce) of construction M+N, comprising an inner layer (Ci) having M wires of diameter $d_1$ wound together in a helix at a pitch $p_1$, M varying from 2 to 4, and an outer layer (Ce) of N wires of diameter $d_2$, wound together in a helix at a pitch $p_2$ around the inner layer (Ci), the method comprising the following steps performed in line: a step of assembling the M core wires by twisting to form the inner layer (Ci) at a point of assembling; downstream of the point of assembling of the M core wires, a step of sheathing the inner layer (Ci) with a diene rubber composition called "filling rubber", in the raw state; a step of assembling the N wires of the outer layer (Ce) by twisting around the inner layer (Ci) thus sheathed; and a step of twist balancing. Also disclosed is a device for implementing such a method.

16 Claims, 4 Drawing Sheets

METHOD AND DEVICE FOR MANUFACTURING A CABLE COMPRISING TWO LAYERS OF THE IN SITU COMPOUND TYPE

RELATED APPLICATIONS

This is a U.S. national stage under 35 USC §371 of application Ser. No. PCT/EP2008/011001, filed on Dec. 22, 2008.

This application claims the priority of French application no. 07/09163 filed Dec. 28, 2007, the entire content of which is hereby incorporated by reference.

FIELD OF THE INVENTION

The present invention relates to methods and devices for manufacturing two-layer metal cables, of construction M+N, usable in particular for reinforcing rubber articles, particularly tires.

It relates more particularly to methods and devices for manufacturing metal cables of the type that are "rubberized in situ", that is to say rubberized from the inside, while they are actually being manufactured, with rubber in the raw state, so as to improve their resistance to corrosion and thus their endurance, particularly in the belts of tires for industrial vehicles.

BACKGROUND OF THE INVENTION

A radial tire comprises, in the known way, a tread, two inextensible beads, two sidewalls joining the beads to the tread and a belt arranged circumferentially between the carcass reinforcement and the tread. This belt is made up of various plies (or "layers") of rubber which may or may not be reinforced with reinforcing elements ("reinforcements") such as cables or monofilaments, of the metallic or textile type.

The tire belt is generally made up of at least two superposed belt plies, sometimes referred to as "working" plies or "crossed" plies, the generally metallic reinforcing cables of which are arranged practically parallel to one another within a ply, but crossed from one ply to the other, that is to say inclined, symmetrically or otherwise, relative to the median circumferential plane, by an angle which is generally of between 10° and 45° depending on the type of tire in question. The crossed plies may be supplemented by other plies or auxiliary layers of rubber, of widths which are variable depending on the case, and which may or may not comprise reinforcements; mention will be made by way of example of simple cushions of rubber, of what are called "protective" plies, the role of which is to protect the rest of the belt from external attack and perforation, or alternatively what are called "hooping" plies comprising reinforcements oriented substantially in the circumferential direction (what are called "zero-degree" plies), be they radially external or internal relative to the crossed plies.

A tire belt such as this must, in the known manner, fulfil various demands, which are frequently contradictory, in particular:

- be as rigid as possible at low deformation, because it contributes substantially to the stiffening of the crown of the tire;
- have a hysteresis which is as low as possible, in order on the one hand to minimize the heating during running of the inner zone of the crown and, on the other hand, to reduce the rolling resistance of the tire, which is synonymous with the saving of fuel;

- and finally have high endurance, with respect in particular to the phenomenon of separation, cracking of the ends of the crossed plies in the shoulder zone of the tire, known by the name of "cleavage", which requires in particular the metal cables which reinforce the belt plies to have high fatigue strength in compression, all in a more or less corrosive atmosphere.

The third demand is particularly strong for tire covers for industrial vehicles such as heavy vehicles, which tires are designed to be able to be retreaded one or more times when the treads which they comprise reach a critical degree of wear after prolonged running.

For the reinforcement of the above belts, use is generally made of steel cables ("steel cords"), referred to as "layered" ("layered cords") consisting of a central core and of one or more concentric layers of wires arranged around this core. The layered cables most widely used are essentially cables of construction M+N or M+N+P, formed of a core of M wire(s) surrounded by at least one layer of N wires, possibly itself surrounded by an outer layer of P wires, the M, N or even P wires generally having the same diameter for reasons of simplicity and cost.

The availability of carbon steels which are becoming ever stronger and more enduring means that tire manufacturers nowadays, as much as possible, are tending towards the use of cables having only two layers, in order in particular to simplify the manufacture of these cables, to reduce the thickness of the composite reinforcing plies and thus the hysteresis of the tires in order ultimately to reduce the costs of the tires themselves and reduce the energy consumption of the vehicles fitted with such tires.

For all of the abovementioned reasons, the two-layer cables most widely used nowadays in tire belts are essentially cables of construction M+N consisting of a core or inner layer of M wires (particularly of 3 or 4 wires) and of an outer layer of N wires (for example from 6 to 12 wires). The outer layer is relatively unsaturated because of the high diameter of the inner layer caused by the presence of the M core wires, especially when the diameter of the core wires is chosen to be greater than that of the wires of the outer layer.

It is known that this type of construction promotes the ability of the cable to be penetrated from the outside by the calendering rubber of the tire or another rubber article during the curing of the latter and consequently makes it possible to improve the endurance of the cables in terms of fatigue and fatigue-corrosion, particularly with respect to the problem of cleavage mentioned previously.

Moreover, good penetration of the cable with rubber makes it possible, as is known, thanks to there being a smaller volume of air trapped in the cable, to reduce the tire curing times ("press time").

However, cables of 3+N or 4+N construction do have the disadvantage that they cannot be penetrated as far as the core owing to the presence of a channel or capillary at the centre of the three or four core wires, which remains empty after impregnation with the rubber and therefore favourable, through a kind of "wicking" effect, to the propagation of corrosive media such as water. This disadvantage is well known and has been disclosed, for example, in patent applications WO 01/00922, WO 01/49926, WO 2005/071157 and WO 2006/013077.

In order to solve the above problem, it has been proposed that the inner layer Ci be opened up, by parting its wires, by using a single centre wire and that one wire be omitted from the outer layer; thus, the cable obtained, for example of construction 1+3+(N−1), becomes penetrable from the outside right to its centre. In relation to the wires of the inner layer, the centre wire has to be neither too fine, because if it were it would not have the intended desaturating effect, nor too coarse, because if it were, the wire would not remain at the centre of the cable. Typically, a centre wire 0.12 mm in diameter is used, for example, for wires of layer Ci and Ce of diameter 0.35 mm (see, for example, RD (Research Disclosure) August 1990, No. 316107, "*Steel cord construction*").

This first solution, which is relatively expensive because it entails adding a wire which moreover contributes nothing to the strength of the cable, also runs into a manufacturing problem: the centre wire has to be kept under high tension in order to keep the wire at the centre of the cable during cabling or stranding, which tension may in some cases be close to the tensile strength of the wire. Omitting one of the outer wires further reduces the strength of the cable per unit cross section.

Again in an attempt to solve this problem of core penetrability, US patent application 2002/0160213 for its part proposes the production of cables of the M+N type, rubberized in situ, M varying from 2 to 4. The method proposed here consists in using rubber in the raw state to coat individually (that is to say separately, "wire by wire") just one or preferably each of the M wires, upstream of the point of assembling (or point of twisting) thereof, in order to obtain a rubber sheathed inner layer before the N wires of the outer layer are subsequently fitted by stranding around the inner layer thus sheathed.

The method proposed hereinabove presents numerous problems. First of all, sheathing just one wire out of the M wires, for example one wire in three (as illustrated, for example, in FIGS. 11 and 12 of this application), does not guarantee sufficient filling of the finished cable with rubber and therefore does not guarantee that satisfactory resistance to corrosion will be obtained. Second, sheathing each of the M wires wire by wire (as illustrated for example in FIGS. 2 and 5 of that document), although it does actually lead to a filling of the cable, results in the use of excessive quantities of rubber. The rubber protruding from the periphery of the finished cable then becomes prohibitive in industrial stranding and rubberizing conditions.

Because of the extreme stickiness of rubber in the raw state, the cable thus rubberized becomes unusable because of an unwanted sticky effect sticking to the manufacturing tooling or with the turns of cable sticking together when this cable is wound onto a receiving reel, not to mention the fact that it is ultimately impossible for the cable to be calendered properly. It will be recalled that calendering consists in converting the cable, by incorporating between two layers of rubber in the raw state a metallic rubberized fabric that acts as a semi-finished product for any later manufacturing stage, for example for building a tire.

Another problem presented by the isolated sheathing of each of the M wires is the significant space occupied by the use of M extrusion heads. Because of such space occupancy, the manufacture of cables with cylindrical layers (that is to say with pitches $p_1$ and $p_2$ which differ from one layer to the other, or with pitches $p_1$ and $p_2$ which are identical but have different directions of twisting from one layer to the other) have as necessity to be formed in two discontinuous operations: (i) individual sheathing of the wires followed by stranding and winding of the inner layer in a first stage, and (ii) stranding of the outer layer around the inner layer in a second stage. Again, because of the great stickiness of the rubber in the raw state, the intermediate winding and storage of the inner layer demand, when the inner layer is being wound onto a reel, the use of interleaves and wide separating pitches to prevent unwanted sticking-together of the wound layers and, within one and the same layer, between turns.

All the above constraints are highly penalizing from an industrial standpoint and prove paradoxical in seeking high manufacturing rates.

SUMMARY OF THE INVENTION

Applicants have discovered a novel method of twisting and rubberizing in line and continuously that can be applied to the manufacture of M+N cables rubberized in situ, and which is able to address the aforementioned disadvantages.

One aspect of the invention is directed to a method of manufacturing a metal cable having two layers (Ci, Ce) of construction M+N, comprising an inner layer (Ci) consisting of M wires of diameter $d_1$ wound together in a helix at a pitch $p_1$,M varying from 2 to 4, and an outer layer (Ce) of N wires of diameter $d_2$, wound together in a helix at a pitch $p_2$ around the inner layer (Ci), the said method comprising at least the following steps performed in line:

- a step of assembling the M core wires by twisting to form the inner layer (Ci) at a point of assembling;
- downstream of the said point of assembling of the M core wires, a step of sheathing the inner layer (Ci) with a diene rubber composition called "filling rubber", in the raw state;
- a step of assembling the N wires of the outer layer (Ce) by twisting around the inner layer (Ci) thus sheathed;
- a final step of twist balancing.

Another aspect of the invention relates to a device for assembling and rubberizing in line, that can be used to implement the method of the invention, the said device comprising, from upstream downstream, in the direction of travel of the cable in the process of being formed:

- feed means for supplying the M core wires;
- first means for assembling the M core wires by twisting to faun the inner layer;
- means of sheathing the inner layer;
- at the outlet from the sheathing means, second means of assembling the N outer wires by twisting around the core thus sheathed, to form the outer layer;
- at the output from the second assembling means, twist balancing means.

BRIEF DESCRIPTION OF THE DRAWINGS

The invention and the advantages thereof will be readily understood in light of the description and exemplary embodiments which follow, and from FIGS. 1 to 7 which relate to these examples and respectively schematically depict:

one example of the device for twisting and in-situ rubberizing that can be used for implementing the method according to the invention (FIG. 1);

Figure 2:
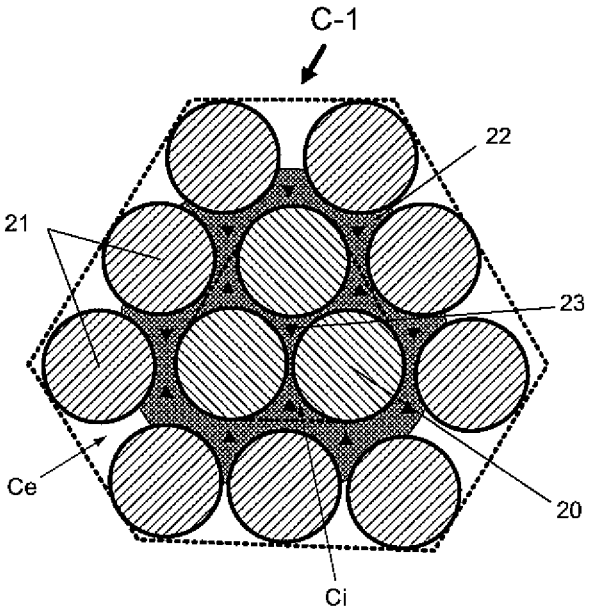
Figure 3:
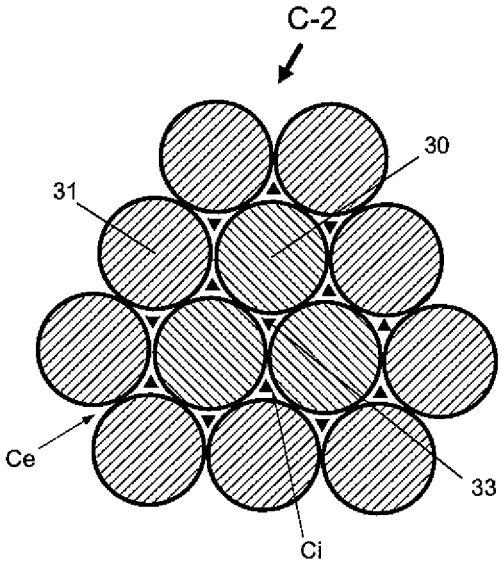
Figure 4:
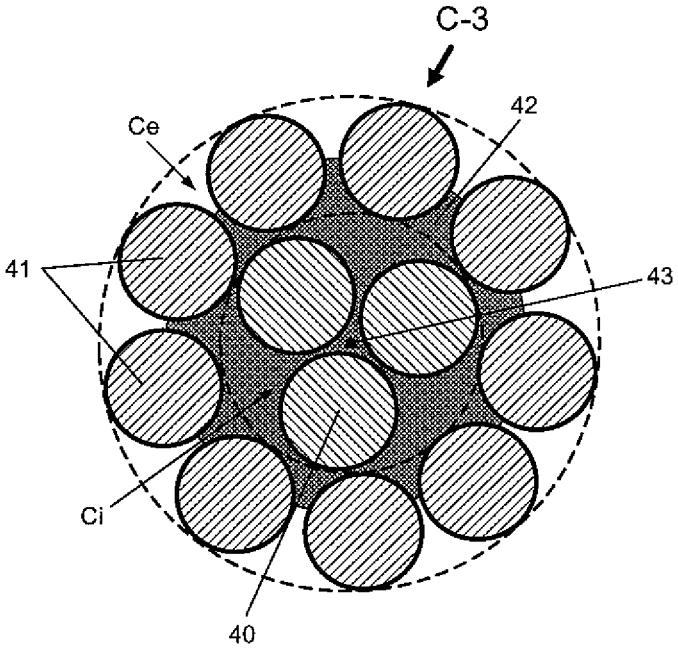
Figure 5:
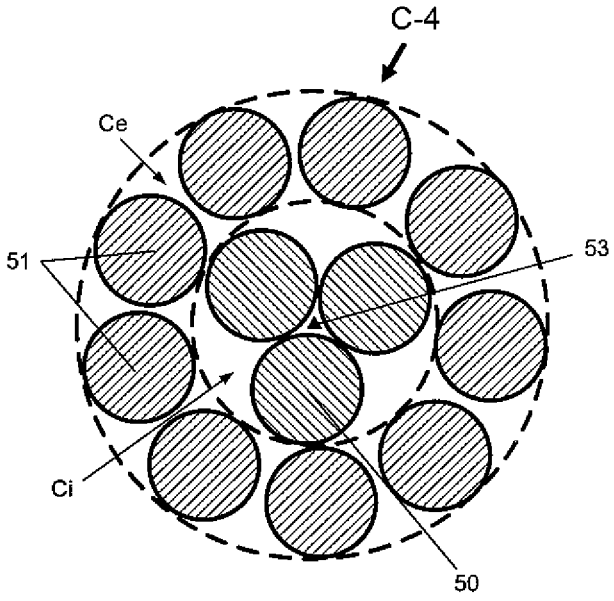
Figure 6:
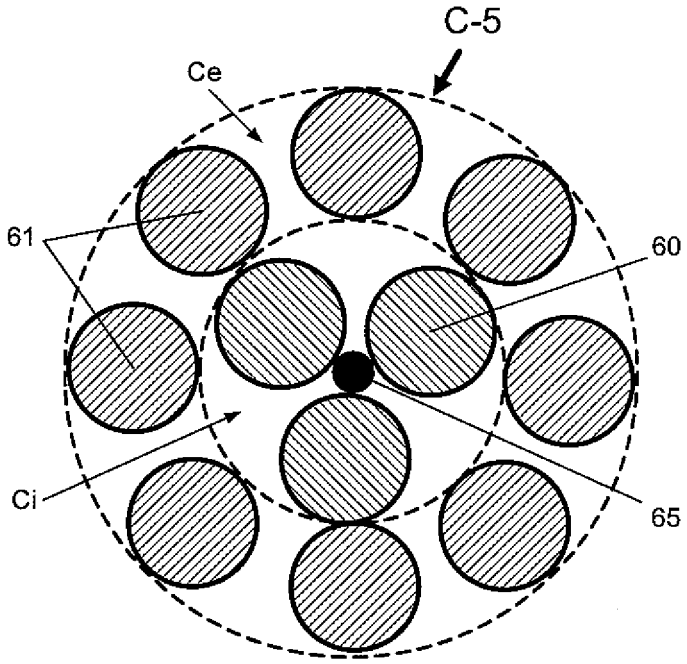
Figure 7:
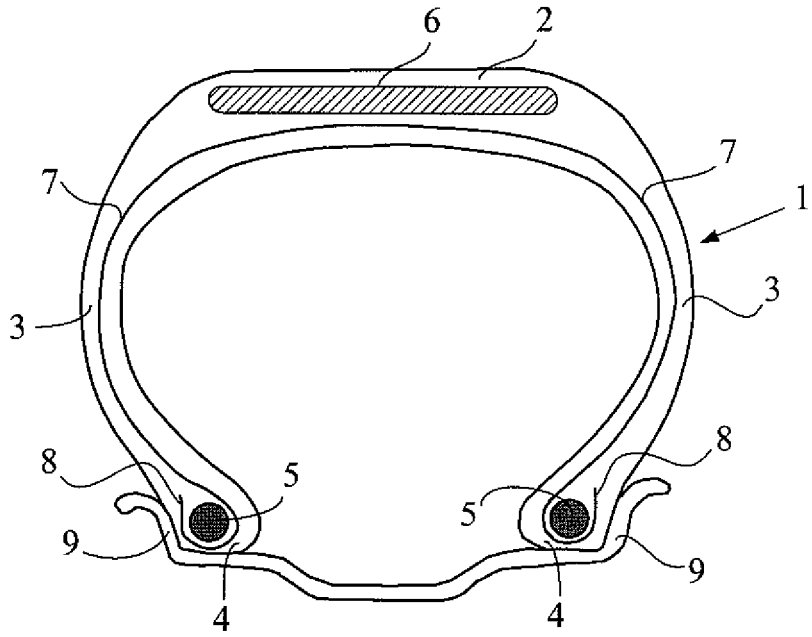

in cross section, a cable of construction 3+9 of the compact type that can be manufactured using the method of the invention (FIG. 2);

in cross section, a conventional cable of construction 3+9, again of compact type (FIG. 3);

in cross section, a cable of construction 3+9 of the type with cylindrical layers that can be manufactured using the method of the invention (FIG. 4);

in cross section, a conventional cable of construction 3+9, again of the type having cylindrical layers (FIG. 5);

in cross section, another conventional cable, of the type with cylindrical layers, of construction 1+3+8 with a very small-diameter core wire (FIG. 6);

in radial section, a heavy goods vehicle tire cover with radial carcass reinforcement (FIG. 7).

I. DETAILED DESCRIPTION OF THE DRAWINGS

In the present description, unless expressly indicated otherwise, all the percentages (%) indicated are per cent by mass. Any range of values denoted by the expression "between a and b" represents the range of values extending from more than a to less than b (that is to say exclusive of the end points a and b) while any range of values denoted by the expression "from a to b" means the range of values extending from a up to b (that is to say inclusive of the strict end points a and b).

The method of the invention is intended for the manufacture of a metal cable having two layers (Ci, Ce) of construction M+N, of the type that is "rubberized in situ", comprising an inner layer (Ci) consisting of M wires of diameter $d_1$ wound together in a helix at a pitch $p_1$, M varying from 2 to 4, and an outer layer (Ce) of N wires of diameter $d_2$, wound together in a helix at a pitch $p_2$ around the inner layer (Ci), the said method comprising at least the following steps performed in line:

- first of all, a step of assembling the M core wires by twisting to form the inner layer (Ci) at a point of assembling;
- then, downstream of the said assembling point of the M core wires, a step of sheathing the inner layer (Ci) with a diene rubber composition called "filling rubber", in the raw (that is to say non-crosslinked) state;
- followed by a step of assembling the N wires of the outer layer (Ce) by twisting around the inner layer (Ci) thus sheathed;
- then by a final step of twist balancing.

It will be recalled here that there are two possible ways of assembling metal wires:

- either by cabling: in which case the wires do not experience any twisting about their own axis, because of a rotation that is synchronous before and after the point of assembling;
- or by twisting: in which case the wires experience both a collective twist and an individual twist about their own axis, generating an untwisting torque on each of the wires.

A first essential feature of the above method is that it uses a twisting step both for assembling the inner layer and for assembling the outer layer.

During the first step, the M core wires are twisted together (S or Z direction) to form the inner layer Ci, in a way known per se; the wires are delivered by feed means such as reels, a splitter plate, which may or may not be coupled with an assembling guide, which are intended to cause the core wires to converge at a common twisting point (or assembling point).

The M wires of the inner layer have, for example, a diameter $d_1$ ranging between 0.20 and 0.50 mm, particularly lying in a range from 0.23 to 0.40 mm; their twisting pitch $p_1$ ranges for example between 5 and 30 mm.

It will be recalled here that, in the known way, the pitch "p" represents the length, measured parallel to the axis of the cable, at the end of which a wire that has this pitch makes one full turn around the said axis of the cable.

The inner layer (Ci) thus formed is then sheathed with filling rubber in the raw state, supplied by an extruder screw at an appropriate temperature. The filling rubber may thus be delivered to a fixed, single, small point, using a single extrusion head, without having to resort to individual sheathing of the wires upstream of the assembling operations before the inner layer is formed, as described in the prior art.

This method has the notable advantage of not slowing the conventional assembling process. It makes it possible for the complete operation of initial twisting, sheathing and final twisting to be performed in line and in a single step, whatever the type of cable produced (cable with compact layers or cable with cylindrical layers), all this being possible at high speed. The method of the invention can be implemented at a speed (speed at which the cable passes through the twisting/sheathing line) in excess of 70 m/min, preferably in excess of 100 m/min.

Downstream of the assembling point (that is to say between the assembling point and the extrusion head), the tensile stress applied to the M wires, which is substantially identical from one wire to the next, preferably ranges between 10 and 25% of the tensile strength of the wires.

The extrusion head may have one or more dies, for example one upstream guide die and one downstream calibration die. It is possible to add means of continuously measuring and checking the diameter of the cable, these being linked to the extruder. For preference, the temperature at which the filling rubber is extruded ranges between 60° C. and 120° C., more preferably between 70° C. and 110° C.

The extrusion head thus defines a sheathing zone in the form of a cylinder of revolution the diameter of which is of course tailored to the specific construction of the cable being manufactured. By way of example, in the case of a cable of construction 3+N, the extrusion diameter preferably ranges between 0.4 and 1.2 mm, more preferably between 0.5 and 1.0 mm. The extrusion length preferably ranges between 4 and 10 mm.

For preference, on leaving the extrusion head, the inner layer Ci, at every point on its periphery, is covered with a minimum thickness of filling rubber which preferably exceeds 5 μm, more preferably exceeds 10 μm, for example ranges between 10 and 50 μm.

The amount of filling rubber delivered by the extrusion head is adjusted to a preferred range extending between 5 and 40 mg per gram of finished cable (i.e. of in-situ rubberized cable).

Below the minimum indicated, it is not possible to guarantee that the filling rubber will indeed be present in each of the gaps of the cable, whereas beyond the maximum indicated, it is possible to run into the various problems described previously due to the protruding of the filling rubber at the periphery of the cable. For all of these reasons, it is preferable for the amount of filling rubber delivered to range between 5 and 30 mg, more preferably still to lie in a range from 10 to 25 mg per g of cable.

The diene elastomer of the filling rubber is preferably chosen from the group consisting of polybutadienes (BR), natural rubber (NR), synthetic polyisoprenes (IR), the various copolymers of butadiene, the various copolymers of isoprene, and blends of these elastomers. A preferred embodiment is to use an "isoprene" elastomer, that is to say an isoprene homopolymer or copolymer, in other words a diene elastomer chosen from the group consisting of natural rubber (NR), synthetic polyisoprenes (IR), the various copolymers of isoprene and blends of these elastomers.

The filling rubber is of the type that can be vulcanized, that is to say generally comprises a vulcanization system designed to allow the composition to crosslink as it is cured, typically based on sulphur and on one or more accelerators. The filling rubber may also contain all or some of the usual additives intended for tire rubber matrices, such as, for example, reinforcing fillers such as carbon black or silica, antioxidants, oils, plasticizers, anti-reversion agents, resins, adhesion promoters such as cobalt salts. For preference, the filling rubber has, in the crosslinked state, a secant tensile modulus E10 (at 10% elongation) that ranges between 5 and 25 MPa, more preferably between 5 and 20 MPa.

On leaving the preceding sheathing step, during a third step, the N wires of the outer layer (Ce) undergo final assembling, again by twisting (S or Z direction) around the inner layer (Ci) thus sheathed. During the twisting, the N wires press against the filling rubber, becoming partially embedded therein. The filling rubber, as it is displaced under the pressure applied by these outer wires, then has a natural tendency to fill, at least in part, each of the gaps or cavities left empty by the wires between the inner layer and the outer layer.

The number N of wires in the outer layer N is of course dependent not only on the respective diameters $d_1$ and $d_2$, but also on the number M of wires of the inner layer. For an M value preferably equal to 3 or 4, it preferably varies from 6 to 12. These N wires have, for example, a diameter $d_2$ ranging between 0.20 and 0.50 mm, particularly contained in a range from 0.23 to 0.40 mm, it of course being possible for $d_2$ to be the same as or different from the diameter $d_1$ of the M core wires.

According to a particularly preferred embodiment, the inner layer comprises 3 or 4 wires, more preferably 3 wires, and the outer layer preferably comprises 8, 9 or 10 wires.

In the case of a 3+N cable, the following relationships are preferably satisfied:

for N=8: $0.7 \leq (d_1/d_2) \leq 1$;

for N=9: $0.9 \leq (d_1/d_2) \leq 1.2$;

for N=10: $1.0 \leq (d_1/d_2) \leq 1.3$.

According to a particularly preferred embodiment, the inner layer comprises 3 wires and the outer layer comprises 9 wires.

The twisting pitch $p_2$, which is the same as or different from the pitch $p_1$, preferably ranges between 10 and 30 mm, more preferably is contained in a range from 12 to 25 mm. For preference, the relationship $0.5 \leq p_1/p_2 \leq I$ is satisfied.

According to another preferred embodiment, the method of the invention is implemented with a $p_1$ and a $p_2$ which are equal.

For preference, the outer layer Ce has the preferred characteristic of being a saturated layer, that is to say that, by definition, there is not enough space in this layer to add at least one $(N_{max}+1)$th wire of diameter $d_2$, $N_{max}$ representing the maximum number of wires that can be wound in a layer around the inner layer Ci. This construction has the advantage of limiting the risk of filling rubber protruding from its periphery and, for a given cable diameter, of offering greater strength.

The number N of wires may vary to a very large extent according to the particular embodiment of the invention, for example from 6 to 12 wires for an inner layer Ci of 3 wires, it being understood that the maximum number $N_{max}$ of wires N will be increased if their diameter $d_2$ is reduced in comparison with the diameter $d_1$ of the M core wires, in order preferably to keep the outer layer saturated.

The M+N cable, like any layered cable, may be of two types, mainly of the compact type or of the type with cylindrical layers.

According to one particularly preferred embodiment of the invention, the wires of the outer layer (Ce) are wound in a helix at the same pitch and in the same direction of twisting (that is to say either in the S direction ("S/S" arrangement) or in the Z direction ("Z/Z" arrangement)) as the wires of the inner layer (Ci) in order to obtain a layered cable of the compact type as depicted schematically for example in FIG. 2.

In such compact layered cables, the compactness is such that practically no distinct layer of wires is visible; the result of this is that the cross section of such cables has a contour which is polygonal and non-cylindrical, as illustrated for example in FIG. 2 (compact 3+9 cable rubberized in situ) and FIG. 3 (conventional compact 3+9 cable, that is to say one that is not rubberized in situ).

After the outer layer has been twisted around the inner layer sheathed with filling rubber, the M+N cable is not yet finished. The central channel delimited by the M core wires, when M is equal to 3 or 4, is not yet full of filling rubber, or in any event is not sufficiently filled to obtain an acceptable air-imperviousness property. When M is equal to 2, the filling rubber surrounds the inner layer without sufficiently penetrating between the two wires which remain in contact with one another, and this may prove detrimental particularly with regard to potential fretting wear risks.

The essential step which follows is to pass the cable through twist balancing means. What is meant here by "twist balancing" is, in the known way, the cancelling out of residual torques (or untwisting springback) exerted on each wire of the cable, both in the inner layer and in the outer layer.

Twist balancing tools are well known to those skilled in the art of twisting; they may for example consist of "straighteners" or "twisters" or "twister-straighteners" consisting either of pulleys in the case of twisters or of small-diameter rollers in the case of straighteners, through which pulleys and/or rollers the cable runs.

It will be assumed a posteriori that, during the passage through the balancing tool, the untwisting applied to the M core wires, causing an at least partial reverse rotation thereof about their axis, is enough to force and drive the still hot and relatively fluid filling rubber in the raw (i.e. non-crosslinked, non-cured) state from the outside towards the core of the cable, into the very inside of the central channel formed by the M wires (for M=3 or 4) or between the very two wires (for M=2) ultimately affording the cable of the invention the excellent air-imperviousness property that characterizes it. The straightening function in addition, afforded by the use of a straightening tool, would have the advantage that contact between the rollers of the straightener and the wires of the outer layer will apply additional pressure to the filling rubber, further encouraging it to penetrate between the M core wires.

In other words, the method of the invention exploits the rotation of the M core wires, at the final stage of manufacture of the cable, and uses it to ensure a natural and uniform distribution of the filling rubber within and around the inner layer (Ci), while at the same time perfectly controlling the amount of filling rubber supplied.

Thus, unexpectedly, it has proved possible to cause the filling rubber to penetrate right to the very core of the cable of the invention by depositing the rubber downstream of the assembling point of the M wires rather than upstream as described in the prior art, and at the same time controlling and optimizing the amount of filling rubber delivered thanks to the use of a single extrusion head.

Following this last twist-balancing step, the manufacture of the cable of the invention is complete. This cable can be wound onto a receiving reel, for storage, before being treated for example through a calendering installation, to prepare a metal/rubber composite fabric.

Thus prepared, the M+N cable can be termed airtight or impervious to air: in the air permeability test described in section II-1-B which follows, it is characterized by a mean air flow rate of less than 2 $cm^3$/min, preferably of less than or at most equal to 0.2 $cm^3$/min.

The method of the invention makes it possible to manufacture M+N cables that can advantageously be devoid (or virtually devoid) of filling rubber at their periphery. What is meant by such an expression is that no particle of filling rubber is visible to the naked eye at the periphery of the cable, that is to say that the person skilled in the art, following manufacture, using his naked eye and at a distance of two or three metres, can discern no difference between a reel of M+N cable rubberized in situ prepared according to the invention and a reel of conventional M+N cable (that is to say of cable that is not rubberized in situ).

This method of the invention of course applies to the manufacture of cables of compact type (as a reminder and by definition, those in which the layers Ci and Ce are wound at the same pitch and in the same direction) and to cables of the type with cylindrical layers (as a reminder and by definition, those in which the layers Ci and Ce are wound either at different pitches or in opposite directions, or even at different pitches and in opposite directions).

A device for assembling and rubberizing according to the invention, that can be used to implement the method of the invention previously described, comprises, from upstream downstream, in the direction of travel of a cable in the process of being formed:

feed means for supplying the M core wires;

means for assembling the M core wires by twisting to form the inner layer;

means of sheathing the inner layer;

at the outlet from the sheathing means, means of assembling the N outer wires by twisting around the core thus sheathed, to form the outer layer;

finally, means of twist balancing.

Figure 1:
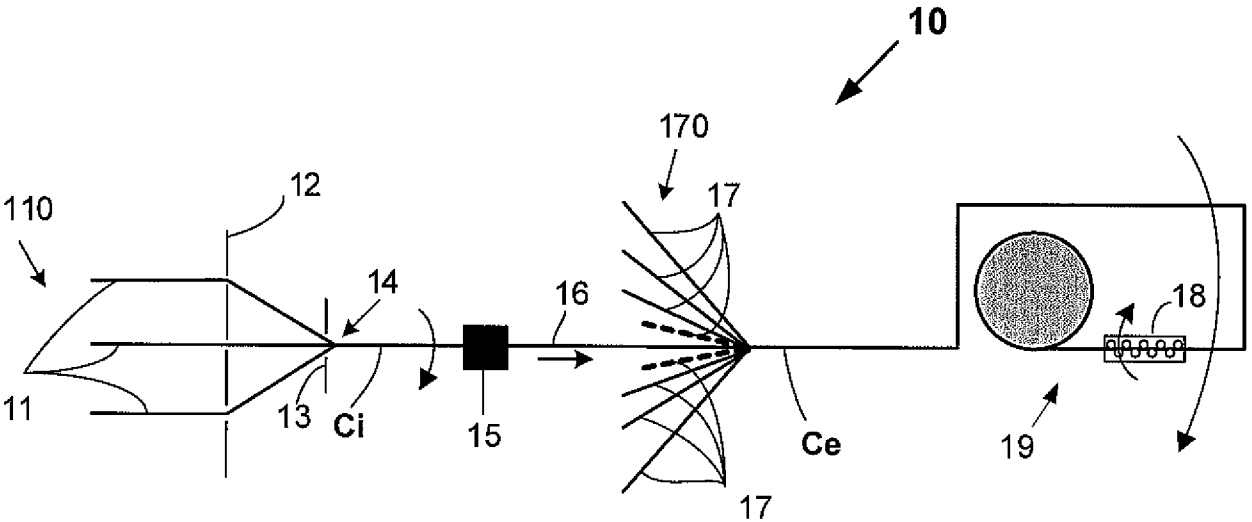

The attached FIG. 1 shows an example of a device (10) for assembling by twisting, of the type with a fixed supply and a rotary receiver, that can be used to manufacture a cable of compact type ($p_2=p_3$ and same direction of twisting of the layers Ci and Ce) as illustrated for example in FIG. 2. In this device, feed means (110) deliver M (for example three) core wires (11) through a splitter plate (12) (axisymmetric splitter), which may or may not be coupled to an assembling guide (13), beyond which the M core wires converge to a assembling point or twisting point (14) to form the inner layer (Ci).

The inner layer Ci, once formed, then passes through a sheathing zone which consists, for example, of a single extrusion head (15) through which the inner layer is intended to pass. The distance between the point of convergence (14) and the sheathing point (15) ranges, for example, between 50 cm and 1 m. The N wires (17) of the outer layer (Ce), of which there are, for example, 9, delivered by feed means (170), are then assembled by twisting around the inner layer Ci thus rubberized (16), progressing in the direction of the arrow. The final M+N cable thus formed is finally collected on a rotary receiving unit (19) having passed through the twist balancing means (18) which, for example, consist of a twister-straightener.

It will be recalled here that, as is well known to those skilled in the art, to manufacture a cable of the type with cylindrical layers like the one illustrated for example in FIG. 4 (pitch $p_2$ and pitch $p_3$ different and/or different directions of twisting of the layers Ci and Ce), use will be made of a device comprising two rotary (feed or receiving) units rather than the one as described hereinabove (FIG. 1) by way of example.

FIG. 2 schematically depicts, in section perpendicular to the axis of the cable (assumed to be straight and at rest), one example of a preferred 3+9 cable rubberized in situ which can be obtained using the method according to the invention previously described.

This cable (denoted C-1) is of the compact type, that is to say that its inner Ci and outer Ce layers are wound in the same direction (S/S or Z/Z according to recognized terminology) and also at the same pitch ($p_1=p_2$). This type of construction means that the inner wires (20) and outer wires (21) form two concentric layers each of which has a contour (depicted in dotted line) that is substantially polygonal (triangular in the case of the layer Ci, hexagonal in the case of the layer Ce) rather than cylindrical as in the case of cables with cylindrical layers which will be described later on.

The filling rubber (22) fills the central capillary (23) (symbolized by a triangle) formed by the three core wires (20), parting them very slightly while at the same time completely covering the internal layer Ci formed by these three wires (20). It also fills each gap or cavity (likewise symbolized by a triangle) formed either by a core wire (20) and the two outer wires (21) immediately adjacent to it, or by two core wires (20) and the outer wire (21) adjacent to them; in total, there are 12 gaps (helicoidal capillaries, also symbolized by a triangle) thus present in this 3+9 cable, plus the central channel or capillary (23).

According to a preferred embodiment, in this 3+N cable, the filling rubber extends continuously around the layer Ci that it covers.

For comparison purposes, FIG. 3 provides a reminder of a cross section through a conventional 3+9 cable (denoted C-2) (that is to say one that is not rubberized in situ), likewise of compact type. The absence of filling rubber means that practically all the wires (30, 31) are in contact with one another, leading to a particularly compact structure that is very difficult (if not to say impossible) for rubber to penetrate from the outside. The characteristic of this type of cable is that the three core wires (30) form a central channel or capillary (33) which is empty and closed and therefore, through a "wicking" effect, likely to encourage the propagation of corrosive media such as water.

FIG. 4 schematically depicts another example of a preferred 3+9 cable according to the invention.

This cable (denoted C-3) is of the type with cylindrical layers, that is to say that its inner Ci and outer Ce layers are either wound at the same pitch ($p_1=p_2$) but in different directions (S/Z or Z/S), or wound at different pitches ($p_1 \neq p_2$) regardless of the directions of twisting (S/S or Z/Z or S/Z or Z/S). In the known way, this type of construction means that the wires are arranged in two adjacent and concentric tubular layers (Ci and Ce) giving the cable (and the two layers) a contour (depicted in dotted line) which is cylindrical rather than polygonal.

The filling rubber (42) fills the central capillary (43) (symbolized by a triangle) formed by the three core wires (40), parting them slightly, while at the same time completely covering the inner layer Ci formed by the three wires (40). It also at least partially (and here in this example completely) fills each gap formed either by a core wire (40) and the two outer wires (41) immediately adjacent (closest) to it, or by two core wires (40) and the outer wire (41) adjacent to them; in total, there are 12 gaps or capillaries thus present in this 3+9 cable, plus the central capillary (43).

For comparison purposes, FIG. 5 provides a reminder of a cross section through a conventional 3+9 cable (denoted C-4) (that is to say a cable not rubberized in situ), likewise of the type with two cylindrical layers. The absence of filling rubber means that the three wires (50) of the inner layer (Ci), concentrically arranged within the ring of outer wires (51), are practically in contact with one another, leading to an empty and closed central capillary (53) that rubber cannot penetrate from the outside and is also likely to encourage the propagation of corrosive media.

The method of the invention also applies advantageously to cables of 2+N construction. Thanks to optimized penetration of the cable with filling rubber from the inside, there is no longer any need for the outer layer to be desaturated in order to improve its penetrability from the outside, particularly with rubber. For the same wire diameters in layers Ci and Ce, this advantageously makes it possible, for example, for cables of 2+7 construction to be replaced with cables of 2+8 construction, which exhibit greater strength for the same overall size.

By way of preferred examples, the method of the invention is used to manufacture cables of 2+6, 2+7, 2+8, 3+7, 3+8, 3+9, 4+8, 4+9, 4+10 construction, and in particular, of these, cables consisting of wires with substantially the same diameter from one layer to the other (namely $d_1=d_2$).

Of course the method of the invention is not restricted to the manufacture of preferred cables in which the wires have diameters ranging between 0.20 and 0.50 mm, as indicated previously. Thus, for example, the method of the invention can be used for manufacturing cables the M and N wires of which have smaller diameters $d_1$ and $d_2$, for example diameters contained in a range from 0.08 to 0.20 mm, it being possible for example for such cables to be used to reinforce parts of tires other than the crown reinforcement thereof, particularly to reinforce the carcass reinforcement of tires for industrial vehicles such as heavy goods vehicles.

II. EXEMPLARY EMBODIMENTS OF THE INVENTION

The tests which follow demonstrate the ability of the method of the invention to provide cables of which the endurance in the tire is appreciably improved by virtue of an excellent air-imperviousness property along the axis of the cable.

II-1. Measurements and Tests Used

A) Dynamometric Measurements

As regards the metal wires and cables, measurements of breaking force, denoted Fm (maximum load in N), tensile strength denoted Rm (in MPa) and elongation at break denoted At (total elongation in percentage) are carried out under tension in accordance with ISO standard ISO 6892 of 1984.

As regards the rubber compositions, the modulus measurements are carried out under tension, unless indicated otherwise in accordance with standard ASTM D 412 of 1998 (test piece "C"): the "true" secant modulus (that is to say one in relation to the actual cross section of the test piece) at 10% elongation, denoted E10 and expressed in MPa, is measured in second elongation (that is to say after an accommodation cycle) (normal conditions of temperature and relative humidity in accordance with standard ASTM D 1349 of 1999).

B) Air-permeability Test

This test is used to determine the longitudinal air-permeability of the cables being tested, by measuring the volume of air passing through a test specimen under constant pressure over a given period of time. The principle behind such a test, well known to those skilled in the art, is to demonstrate the efficiency with which a cable treatment makes the cable impervious to the air; it is described, for example, in standard ASTM D2692-98.

The test here is carried out either on cables taken from tires or from the rubber plies that they reinforce, which are therefore already coated with rubber in the cured state, or on raw as manufactured cables.

In the latter instance, the raw cables have to be embedded in so-called coating rubber sheathing them from the outside beforehand. To do that, a series of 10 cables arranged in parallel (distance between cables: 20 mm) is placed between two skims (two rectangles measuring 80×200 mm) of a rubber composition in the raw state, each skim being 3.5 mm thick; all of this is then immobilized in a mould, each of the cables being kept under enough tension (for example 2 daN) to guarantee that it remains straight when placed in the mould, using clamping modules, then vulcanizing (curing) is carried out for 40 min at a temperature of 140° C. and at a pressure of 15 bar (rectangular piston measuring 80×200 mm). After that, the entity is released from the mould and 10 test specimens of cables thus coated are cut out, in the form of parallelepipeds measuring 7×7×20 mm, ready to be characterized.

By way of coating rubber, use is made of a rubber composition that is conventional for use in tires, based on (peptized) natural rubber and carbon black N330 (65 phr), also containing the following conventional additives: sulphur (7 phr), sulphonamide accelerator (1 phr), ZnO (8 phr), stearic acid (0.7 phr), antioxidant (1.5 phr), cobalt naphthenate (1.5 phr); the E10 modulus of the coating rubber is approximately 10 MPa.

The test is carried out on a 2 cm length of cable, coated therefore with its surrounding rubber composition (or coating rubber) as follows: air is sent into the inlet of the cable at a pressure of 1 bar, and the volume of air at the outlet is measured using a flow meter (calibrated, for example, from 0 to 500 $cm^3$/min). During the measurement, the test specimen of cable is immobilized in a compressed airtight seal (for example a dense foam or rubber seal) such that only the amount of air passing through the cable from one end to the other along the longitudinal axis thereof is taken into consideration by the measurement; the airtightness of the seal is checked beforehand using a solid rubber test specimen, that is to say one with no cable.

The higher the longitudinal impermeability of the cable, the lower the measured flow rate. Because the measurement is performed with a precision of ±0.2 $cm^3$/min, measured values less than or equal to 0.2 $cm^3$/min are considered to be zero; they correspond to a cable which can be qualified as airtight along its axis (i.e. in its longitudinal direction).

C) Content of Filling Rubber

The amount of filling rubber is measured as the difference between the weight of the initial cable (therefore the in-situ rubberized cable) and the weight of the cable (therefore that of its wires) from which the filling rubber has been removed using an appropriate electrolytic treatment.

A test specimen of cable (1 m long), wound onto itself to reduce its size, forms the cathode of an electrolyser (connected to the negative terminal of a generator), while the anode (connected to the positive terminal) consists of a platinum wire. The electrolyte is an aqueous solution (demineralized water) containing 1 mole per litre of sodium carbonate.

The test specimen, fully immersed in the electrolyte, has voltage applied to it for 15 minutes at a current of 300 mA. The cable is then removed from the bath, copiously rinsed with water. This treatment allows the rubber to detach easily from the cable (if it does not, electrolysis is continued for a few minutes more). The rubber is carefully removed, for example by simply wiping it using absorbent cloth, untwisting the wires of the cable one by one. The wires are rinsed again in water then immersed in a beaker containing a mixture of demineralized water (50%) and ethanol (50%); the beaker is placed in an ultrasound tank for 10 minutes. The wires thus stripped of any trace of rubber are removed from the beaker, dried in a stream of nitrogen or air, and finally weighed.

The level of filling rubber in the cable, expressed in mg of filling rubber per gram of initial cable, is then deduced by calculation and averaged over 10 measurements (10 metres of cable in total).

II-2. Production of the Cables

Two types of cable, 3+9 layered cables (referenced C-1) and 1+3+8 layered cables (referenced C-5), the respective constructions of which conform to the schematic depictions of the attached FIGS. 2 and 6 and the mechanical properties of which are given in Table 1 below, were first of all manufactured.

TABLE 1

| Cable | $p_1$ (mm) | $p_2$ (mm) | Fm (daN) | Rm (MPa) | At (%) |
|---|---|---|---|---|---|
| C-1 | 15.4 | 15.4 | 258 | 3140 | 2.5 |
| C-5 | 7.7 | 15.4 | 274 | 2590 | 2.5 |

The C-1 cables as schematically depicted in FIG. 2 were manufactured in accordance with the method according to the invention, using a device as described hereinabove and schematically depicted in FIG. 1. The filling rubber was a rubber composition conventional for a tire crown reinforcement, with the same formulation as that of the rubber ply of the belt ply that the cable C-1 is intended to reinforce in the in-tire test that follows. This composition was extruded at a temperature of 90° C. through a sizing die measuring 0.700 mm.

Each cable C-1 is made up of 12 wires in total, all of diameter 0.30 mm, which have been wound at the same pitch ($p_1$=$p_2$=15.4 mm) and in the same direction of twisting (S) to obtain a cable of compact type. The level of filling rubber, measured in accordance with the method indicated hereinabove at section II-1-C, is 16 mg per g of cable. This filling rubber fills the central channel or capillary formed by the three core wires, parting them slightly, and at the same time completely covering the internal layer Ci formed by the three wires. It also fills, at least in part if not completely, each of the twelve empty channels or gaps formed either between a core wire and the two outer wires immediately adjacent to it or between two core wires and the outer wire adjacent to them.

The cables C-5 as depicted in FIG. 6 were manufactured using a conventional method. They have no filling rubber. Each cable C-5 comprises a core wire (65) of very small diameter (0.12 mm); the three inner wires (60) and the eight outer wires (61) each have a diameter of 0.35 mm. The three wires in the inner layer are wound together in a helix (S direction) at a pitch $p_1$ equal to 7.7 mm, this layer Ci being in contact with a cylindrical outer layer of eight wires themselves wound together in a helix (S direction) around the core at a pitch $p_2$ equal to 15.4 mm. The core wire (65), by parting the wires (60) of the inner layer Ci and in some way filling the central channel formed by these three core wires (60), allows the outer layer Ce (for wire diameters identical from one layer to the other) to be desaturated (by increasing the diameter of the inner layer Ci) thus increasing the ability of rubber to penetrate the cable (C-5) from the outside. Thanks to this construction, the cable C-5 becomes penetrable from the outside all the way to its centre.

All the wires used for manufacturing these cables are thin carbon-steel wires manufactured using known methods, and the properties of which are given in Table 2 below.

TABLE 2

| Steel | ϕ (mm) | Fm (N) | Rm (MPa) |
|---|---|---|---|
| SHT | 0.30 | 226 | 3200 |
| HT | 0.35 | 263 | 2765 |

The layered cables C-1 and C-5 are then incorporated by calendering into plies (skims) of rubber made of a conventional rubber composition that can be used for manufacturing belt plies of radial tires for heavy vehicles. This composition is based on (peptized) natural rubber and on carbon black N330 (55 phr); it also contains the following conventional additives: sulphur (6 phr), sulphenamide accelerator (1 phr), ZnO (9 phr), stearic acid (0.7 phr), antioxidant (1.5 phr), cobalt naphthenate (1 phr); the E10 modulus of the filling rubber is about 6 MPa.

II-3. Testing of Cables in Tire Crown Reinforcement

Cables C-1 and C-5 were then tested in a belt of a tire for a heavy goods vehicle as depicted in FIG. 7.

This radial tire 1 has a crown 2 reinforced by a crown reinforcement or belt 6, two side walls 3 and two beads 4, each of these beads 4 being reinforced with a bead wire 5. The crown 2 is surmounted by a tread, not depicted in this schematic figure. A carcass reinforcement 7 is wound around the two bead wires 5 in each bead 4, the turned-back portion 8 of this reinforcement 7 for example being positioned towards the outside of the tire 1 which is here depicted as mounted on its rim 9. The carcass reinforcement 7 is, in the way known per se, made up of at least one ply reinforced with so-called "radial" cables, that is to say cables which are arranged practically parallel to one another and which run from one bead to the other to make an angle of between 80° and 90° with the median circumferential plane (plane perpendicular to the axis of rotation of the tire and which is situated mid-way between the two beads 4 and passes through the middle of the crown reinforcement 6). Of course, this tire 1 also comprises, in the known way, an interior layer of rubber or elastomer (commonly known as the "inner liner") which defines the radially internal face of the tire and is intended to protect the carcass ply from any diffusion of air from the space inside the tire.

The crown reinforcement or belt 6 is, in a way known per se, made of two triangulation half-plies reinforced with metal cables inclined at 65 degrees, surmounted by two superposed crossed "working plies". These working plies are reinforced with metal cables arranged substantially parallel to one another and inclined by 26 degrees (radially inner ply) and 18 degrees (radially outer ply). The two working plies are furthermore covered by a protective ply reinforced with conventional (high elongation) elastic metal cables inclined by 18 degrees. All the angles of inclination indicated are measured relative to the median circumferential plane of the tire.

In the tests which follow, the two "working plies" mentioned above use either the cables C-1 or the cables C-5 manufactured beforehand.

Two series of running tests for heavy-vehicle tires (denoted P-1 and P-5 respectively) of dimensions 315/70 R22.5 were then carried out, with tires intended for running and others for decortication on a new tire, in each series. The tires P-1 and P-5 are identical except for the cables that reinforce their belt 6. The tires P-1 are reinforced with the cables C-1 manufactured according to the method of the invention, and the tires P-5 are reinforced with the cables C-5 which, because of their recognized performance particularly in comparison with conventional 3+9 cables (with no individual core wire), form the control of choice for this type of test.

These tires are made to undergo a stringent miming test, under overload conditions, intended to test their resistance to the phenomenon known as "cleavage" (separation of the ends of the belt plies), by subjecting the tires (on an automatic rolling machine) to sequences of very strong cornering and strong compression of their crown block in the shoulder zone.

The test is carried out until forced destruction of the tires occurs.

It is then found that the tires P-1 reinforced with the cables produced by the method of the invention, under the very severe miming conditions imposed upon them, exhibit distinctly improved endurance: the average distance travelled is increased by 20% relative to the control tires which furthermore already exhibit excellent performance.

II-4. Air Permeability Tests

The cables C-1 manufactured using the method of the invention were also subjected to the air permeability test (section II-1-B) by measuring the volume of air passing through the cables in one minute (average of 10 measurements for each cable tested).

For each cable C-1 tested and for 100% of the measurements (namely ten test specimens out of ten), a zero flow rate or flow rate below 0.2 $cm^3$/min was measured; the cables C-1 are therefore impermeable to air and can be qualified as airtight along their axis within the meaning of the test of section II-1-B, this thanks to an optimal level of penetration with rubber (filling rubber).

Control cables rubberized in situ, with the same 3+9 construction as the cables C-1, were also manufactured, sheathing either just one wire or each of the three wires of the inner layer Ci individually. This sheathing was performed using extrusion dies of varying diameter (320 to 420 μm) this time positioned upstream of the point of assembling (sheathing and twisting in line) as described in the prior art (the aforementioned application US 2002/160213); for a rigorous comparison, the amount of filling rubber delivered was adjusted so that the level of filling rubber in the finished control cables (namely between 6 and 25 mg per g of cable as measured in accordance with the method at section II-1-C) was similar to that of the cables of the invention.

When it was just one wire that was sheathed, irrespective of the cable tested, it was found that 100% of the measurements (i.e. 10 test specimens out of 10) indicated an air flow rate in excess of 2 $cm^3$/min; the mean flow rate measured varied from 16 to 62 $cm^3$/min according to the operating conditions used, particularly according to the diameter of extrusion die tested.

When each of the three wires was sheathed individually, even though the mean flow rate measured (which varied from 0.2 to 4 $cm^3$/min) was lower than the previous values, it was found that:

- in the worst cases (320 μm die), 90% of the measurements (namely 9 test specimens out of 10) exhibited a flow rate in excess of 2 $cm^3$/min, with a mean flow rate of 4 $cm^3$/min;
- in the best of cases (420 μm die), 10% of the measurements (namely 1 test specimen out of 10) still had a flow rate of around 2 $cm^3$/min, with a mean flow rate of around 0.2 $cm^3$/min.

In other words, not one of the above control cables tested can be qualified as a cable that is airtight along its longitudinal axis.

Furthermore, it was found that of these control cables, those that had the lowest air permeability (as a reminder, those obtained by individually sheathing each of the three wires through a 420 μm die) had a relatively high amount of filling rubber at their periphery, making them ill-suited to industrial-scale calendering.

To sum up, the method of the invention allows the manufacture of cables of M+N construction, rubberized in situ and which, thanks to an optimal degree of penetration with the rubber, firstly can be used effectively under industrial conditions, particularly without the difficulties associated with excessive rubber protruding at the time of manufacture, and secondly have an endurance in tire belts that is appreciably improved by comparison with the best control cables hitherto known for such applications.

The invention claimed is:

1. A method of manufacturing a metal cable having two layers (Ci, Ce) of construction M+N, comprising an inner layer (Ci) having M core wires of diameter $d_1$ wound together in a helix at a pitch $p_1$, M varying from 2 to 4, and an outer layer (Ce) of N wires of diameter $d_2$, wound together in a helix at a pitch $p_2$ around the inner layer (Ci), the method comprising:

- assembling the M core wires by twisting to form the inner layer at a point of assembling;
- sheathing the inner layer with a diene rubber composition called "filling rubber" in a raw state downstream of the point of assembling of the M core wires;
- assembling the N wires of the outer layer by twisting the N wires around the sheathed inner layer to form the metal cable; and
- twist balancing the metal cable to force the filling rubber in the raw state toward a central channel of the cable.

2. The method according to claim 1, wherein the diameter $d_1$ ranges between 0.20 and 0.50 mm and the twisting pitch $p_1$ ranges between 5 and 30 mm.

3. The method according to claim 1, wherein the tensile stress applied to the M core wires downstream of the point of assembling ranges between 10 and 25% of their tensile strength.

4. The method according to claim 1, wherein a diene elastomer of the filling rubber is chosen from the group consisting of polybutadienes, natural rubber, synthetic polyisoprenes, butadiene copolymers, isoprene copolymers and blends of these elastomers.

5. The method according to claim 4, wherein the diene elastomer is natural rubber.

6. The method according to claim 1, wherein an extrusion temperature of the filling rubber ranges between 60° C. and 120° C.

7. The method according to claim 1, wherein an amount of filling rubber delivered during sheathing ranges between 5 and 40 mg per gram of finished cable.

8. The method according to claim 1, wherein the inner layer, after sheathing, is covered with a minimum thickness of the filling rubber that exceeds 5 μm.

9. The method according to claim 1, wherein the diameter $d_2$ ranges between 0.20 and 0.50 mm and the pitch $p_2$ is greater than or equal to $p_1$.

10. The method according to claim 1, wherein the wires of the outer layer are wound in a helix at the same pitch and in the same direction of twisting as the wires of the inner layer.

11. The method according to claim 1, wherein M is equal to 3 and N is equal to 8, 9 or 10.

12. The method according to claim 1, wherein the outer layer is a saturated layer.

13. A device for assembling and rubberizing in line, that can be used to implement a method according to claim 1, the device comprising, from upstream downstream, in the direction of travel of a cable in the process of being formed:

- feed means for supplying M core wires;
- first means for assembling the M core wires by twisting to form an inner layer;
- means for sheathing the inner layer to form a sheathed core;
- second means for assembling N outer wires arranged at an outlet of the sheathing means and configured to twist the N outer wires around the sheathed core to form the outer layer; and
- means for twist balancing arranged at an output of the second means for assembling and configured to twist balance the cable to force the sheathing toward a central channel formed by the M core wires.

14. The device according to claim 13, comprising a fixed feed and a rotary receiver.

15. The device according to claim 13, wherein the sheathing means consist of a single extrusion head comprising at least one sizing die.

16. The device according to claim 13, wherein the means for balancing the twist of the wires comprise a straightener or a twister or a twister-straightener.

* * * * *